US005617749A

United States Patent [19]

Park

[11] Patent Number: 5,617,749

[45] Date of Patent: Apr. 8, 1997

[54] DOOR LOCK

[75] Inventor: Jung W. Park, Taegu, Rep. of Korea

[73] Assignee: Dusan Metals, Inc., Taegu, Rep. of Korea

[21] Appl. No.: 650,296

[22] Filed: May 30, 1996

[51] Int. Cl.[6] ..... E05B 13/10

[52] U.S. Cl. ..... 70/224; 70/221; 70/422; 70/472; 292/336.3; 292/DIG. 27

[58] Field of Search ..... 70/188, 189, 204, 70/149, 472, 218, 221–223, 224, 422; 292/356, DIG. 27, DIG. 61, 336.3

[56] References Cited

U.S. PATENT DOCUMENTS

| | | | |
|---|---|---|---|
| 4,655,059 | 4/1987 | Best et al. | 70/224 |
| 4,679,420 | 7/1987 | Yang | 70/422 |
| 4,773,240 | 9/1988 | Foshee | 70/224 X |
| 4,998,760 | 3/1991 | Nixon et al. | 292/DIG. 61 X |
| 5,040,652 | 8/1991 | Fish et al. | 70/422 X |
| 5,067,758 | 11/1991 | Fann et al. | 292/356 X |
| 5,177,987 | 1/1993 | Shen | 70/224 |
| 5,481,890 | 1/1996 | Millman | 70/224 |

FOREIGN PATENT DOCUMENTS

| | | | |
|---|---|---|---|
| 948682 | 8/1949 | France | 70/221 |

*Primary Examiner*—Lloyd A. Gall
*Attorney, Agent, or Firm*—Schmeiser, Olsen & Watts

[57] ABSTRACT

An improved door lock is disclosed whereby the application of excessive force on the door handle will not cause a malfunction of the door lock and will not cause damage to the internal working features of the door lock. The door lock includes an outer rose spindle assembly, having an inner and an outer spindle, wherein the two spindle portions are releasably connected by a plurality of complementary pins and dints. Upon the application of excessive force on the door handle, the pins are released from the dints such that the force is not further transmitted to sequential features of the lock body.

3 Claims, 6 Drawing Sheets

DOOR LOCK

FIELD OF THE INVENTION

This invention relates generally to locks, and more particularly, to an improved door lock mechanism designed to protect the inner working features, or lock body, from damage due to exertion of excessive turning force on the door handle when the door is locked.

BACKGROUND OF THE INVENTION

Frequently, damage can be done to the inner working features, or lock body, of a door lock upon the exertion of excessive turning force on the door handle when the door is in a locked position. The damage can often be severe and require expensive repairs or even replacement of the entire door lock. Moreover, applying excessive turning force to the handle can cause a malfunction of the lock, thereby allowing the door to be opened, when in fact, it is intended to be locked.

It is therefore desirable to provide a new door lock mechanism which is capable of protecting the inner lock body of a door lock from excessive turning force that may be applied to the door handle.

SUMMARY OF THE INVENTION

It is an object of the present invention to provide a new door lock mechanism which prevents excessive turning force, applied to the door handle, from being transmitted to the inner working features of the lock body.

It is another object of the present invention to provide a new door lock mechanism that is capable of protecting the inner lock body from malfunction due to the exertion of excessive turning force on the door handle when the door is locked.

It is a further object of the present invention to provide a door lock mechanism having a divided outer rose spindle and key connecting members.

DETAILED DESCRIPTION OF THE DRAWINGS

Figure 1:
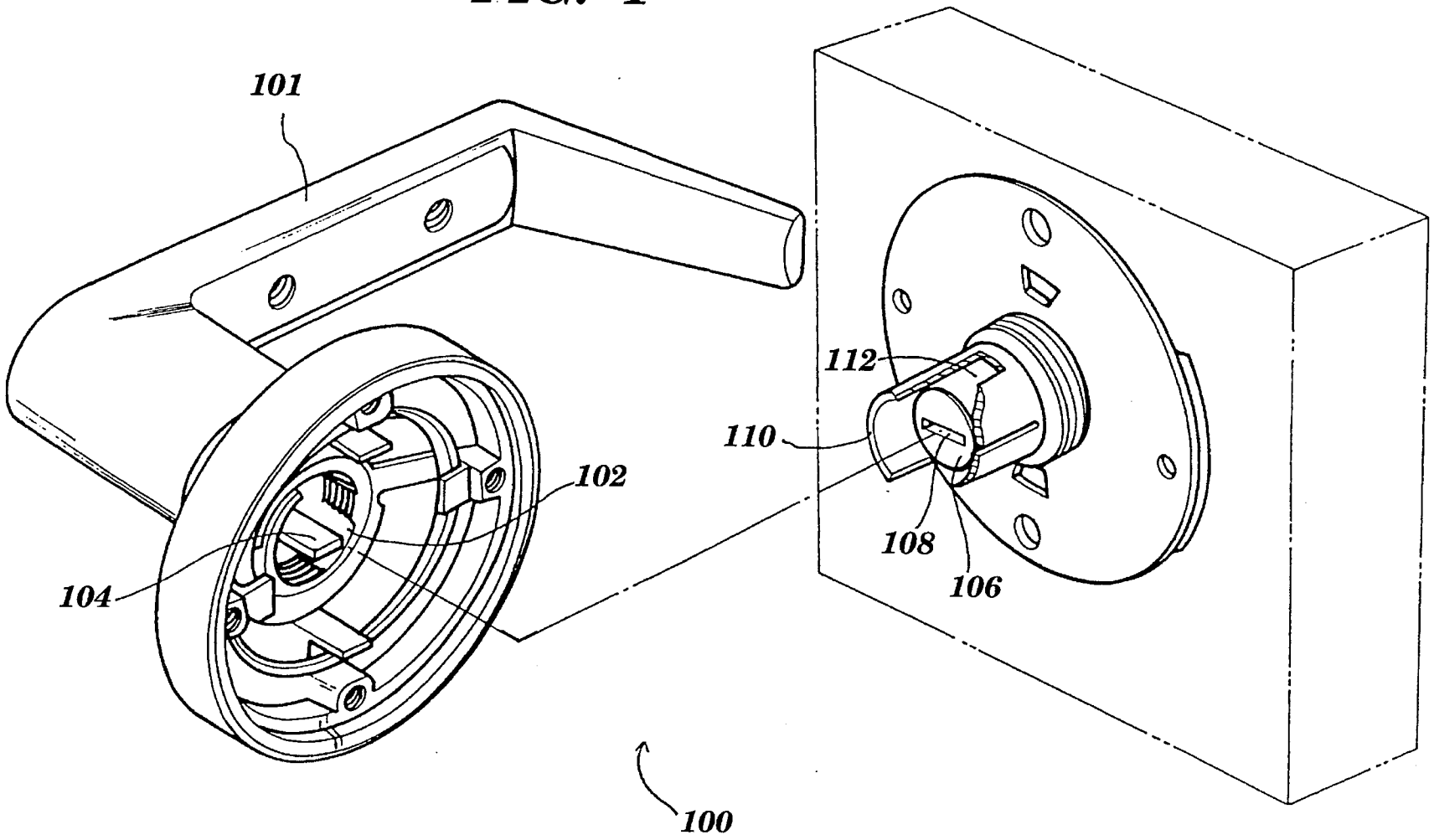
FIG. 1 is a partially disassembled view of a previous door lock.
Figure 2:
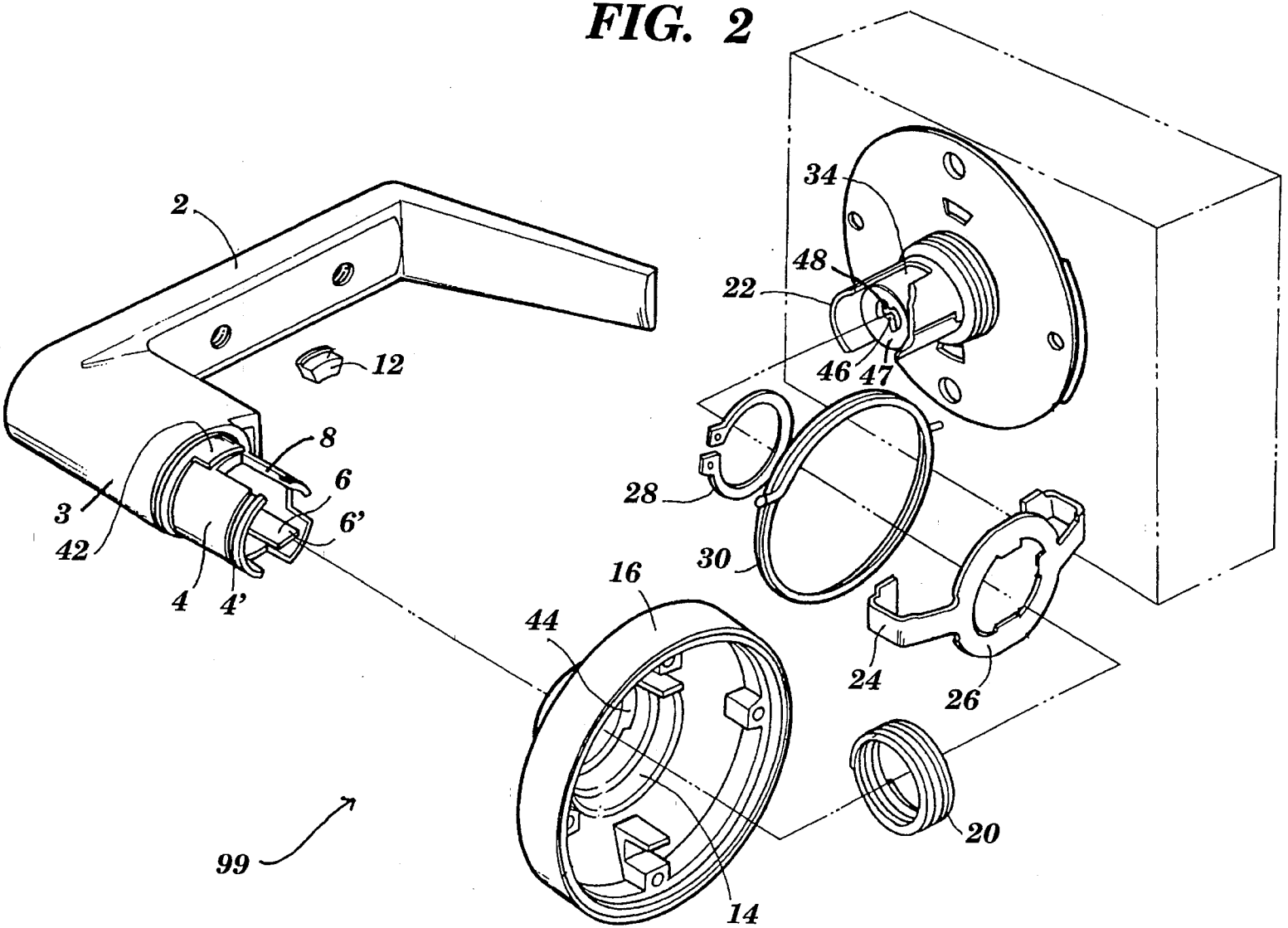
FIG. 2 is an exploded view of the door lock of the present invention.
Figure 4:
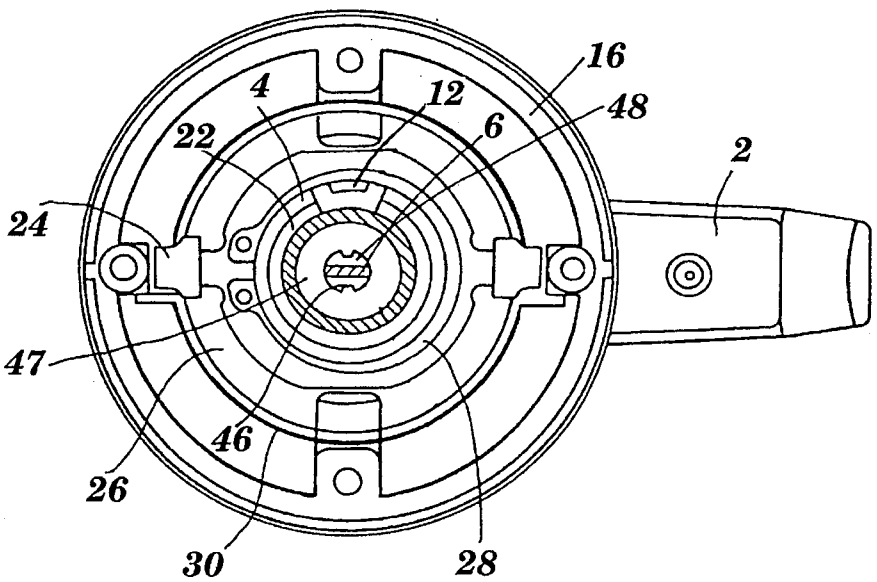
FIG. 4 is a frontal view of the lock housing of the door lock of the present invention, showing the orientation of features, including the spring holder, at rest.
Figure 3:
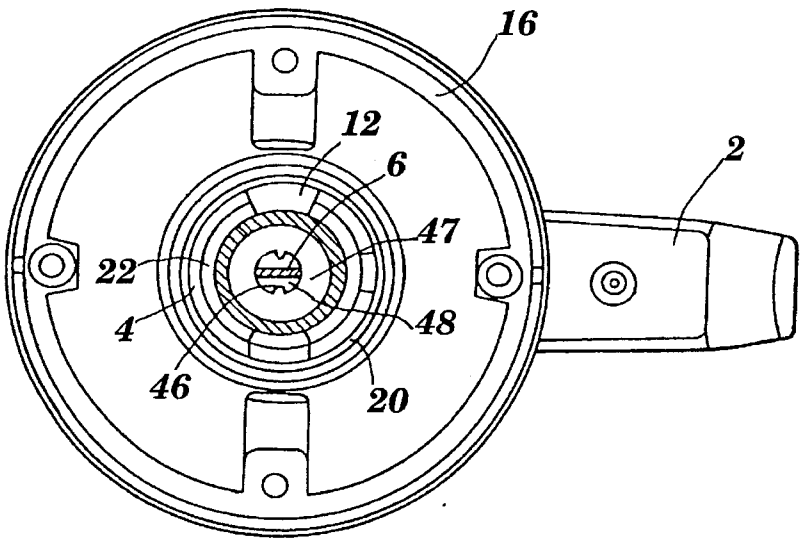
FIG. 3 is a frontal view of the lock housing of the door lock of the present invention, showing the orientation of the hook in relation to features at rest.
Figure 6:
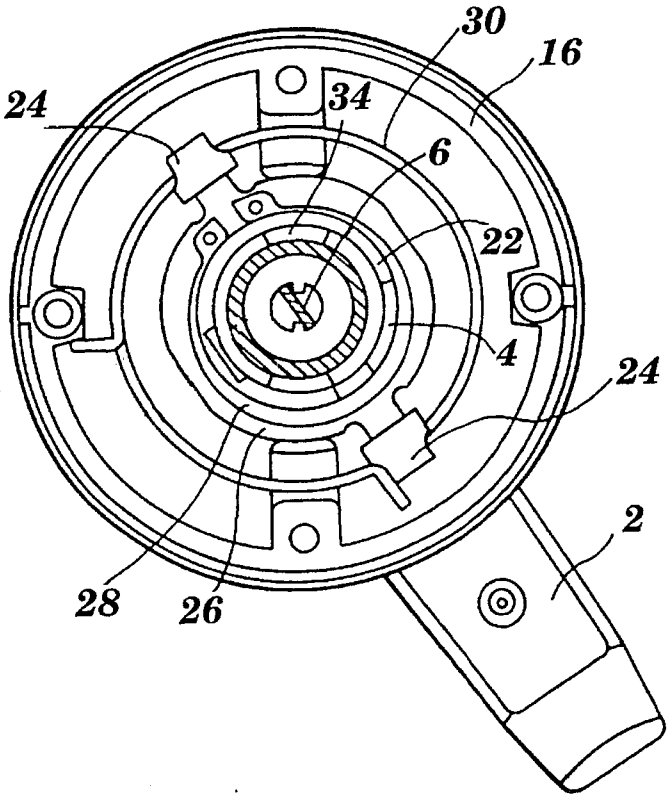
FIG. 6 is a frontal view of the lock housing of the door lock of the present invention, showing the orientation of features, including the spring holder, during the application of rotating force to the door handle.
Figure 5:
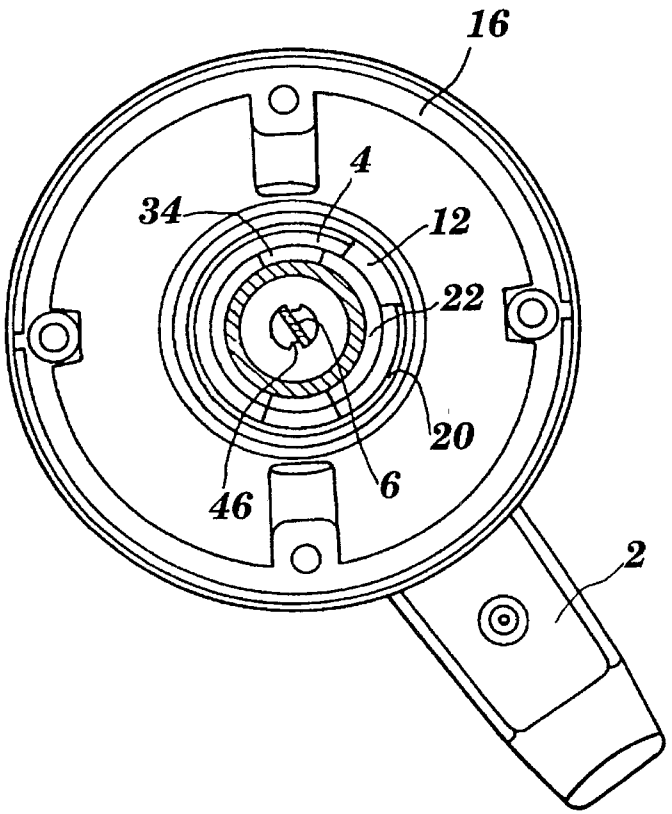
FIG. 5 is a frontal view of the lock housing of the door lock of the present invention, showing the orientation of the hook in relation to features during the application of rotating force to the door handle.
Figure 7:
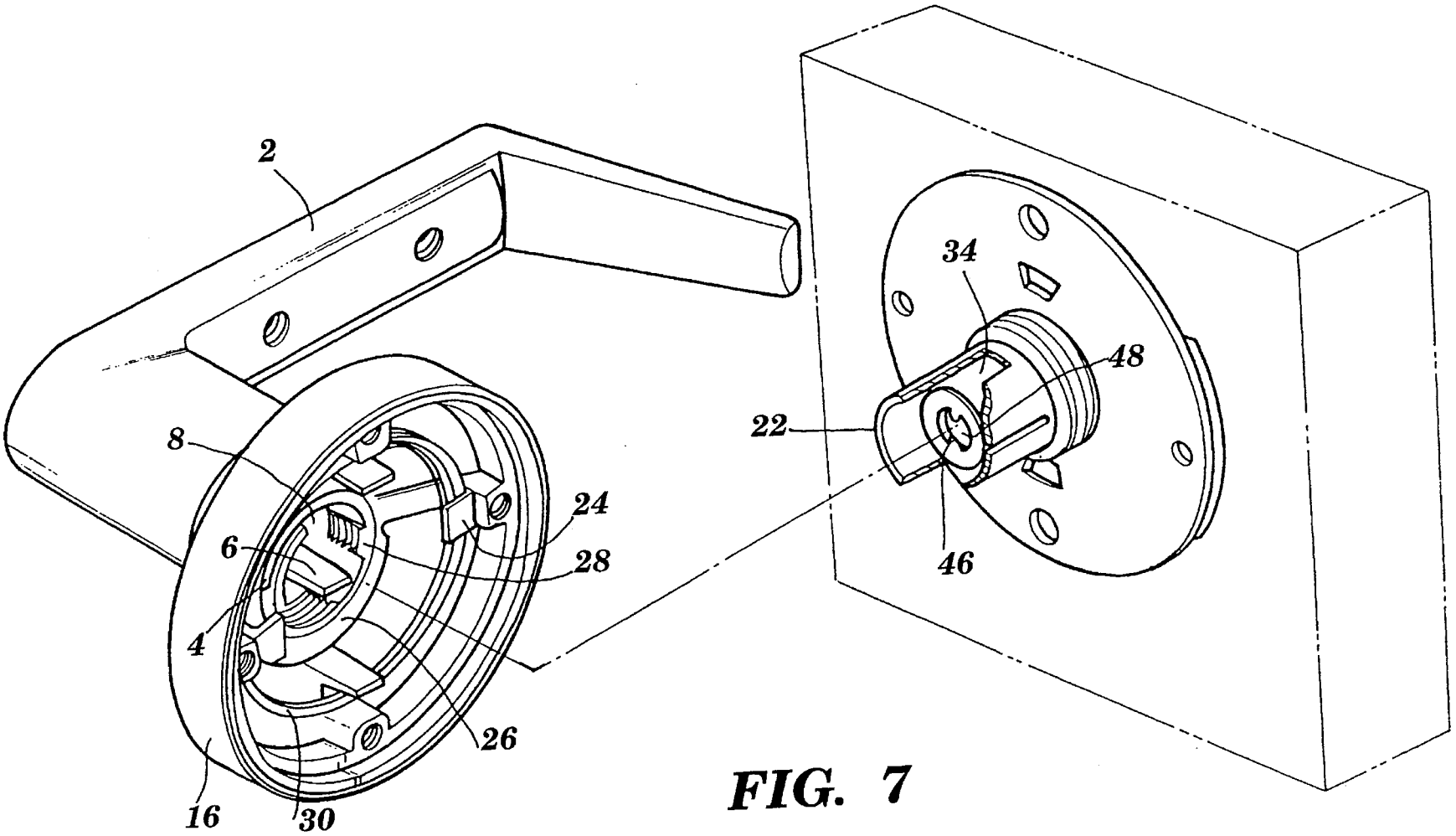
FIG. 7 is a partially disassembled view of the door lock of the present invention.

Referring now specifically to the drawings, there is illustrated a door lock assembly, generally designated as 99, wherein like reference numerals refer to like elements throughout the drawings.

FIG. 1 shows a disassembled perspective view of a previous door lock, generally designated as 100. Here, handle 101, which includes a key cylinder (not shown), is fixedly inserted into outer spindle 102. Extending from outer spindle 102, and more specifically from inner operator (not shown) is connecting bar 104. When lock assembly 100 is fully engaged, connecting bar 104 will be inserted into a slit 108 of rotating lock body 106, and outer spindle 102 will encompass rotating tube 110. Rotating lock body 106 operates the rotation and retraction of the door-opening latch bolt (not shown). Accordingly, by transmitting rotating force from handle 101, to rotating lock body 106, the door can be opened, and similarly, when the door is in the locked position, rotating force applied to handle 101 will not be transmitted from outer spindle 102 to rotating tube 110 or rotating lock body 106, and the door can not be opened. Therefore, the application of excessive force to handle 101 can cause damage to or malfunction of, the inner working features of the door lock.

As illustrated by FIGS. 2 through 7, door lock assembly 99 includes a handle 2, having a hollow end portion 3 which further includes a key cylinder (not shown) and a connecting bar 6. Inserted into hollow end portion 3 such that it encompasses the key cylinder and connecting bar 6, is open-ended, cylindrical outer spindle 4. The end of outer spindle 4 which is distal from lever 2 includes a plurality of slots 8, which are notched axially about outer spindle 4. Shaped to be received within slots 8 are hooks 12. Accordingly, hooks 12 are generally trapezoidal-shaped, as if cut from the circumference of outer spindle 4. The two side faces of hook 12 are oblique-shaped. When inserted into slot 8, the lower portion of hook 12 extends into the open area of outer spindle 4.

Open-ended, hollow outer housing 16, is mounted over outer spindle 4 in a way typical of door knob lock housings. The narrow, operating room of housing 16 is designated as 14 in FIG. 2. Outer spindle 4 includes a connecting extruder 42, proximate the point of attachment of handle 2, which is engaged within inner connecting channel 44 of housing 16. The length of channel 44 is longer than that of extruder 42, thus allowing outer spindle 4 to rotate to a certain degree. Following the coupling of housing 16 and handle 2, outer spindle 4, including hooks 12, will be positioned within operating room 14. A coil spring 20 is tightly mounted over outer spindle 4, and hooks 12, providing tensile movement for hooks 12. Inserted within outer spindle 4 is rotating tube 22, which includes slot 34 in its periphery. Slot 34 is oblique-shaped, to receive the lower portion of hook 12. Included within the interior of rotating tube 22 is disk 47 having aperture 48 therein to receive end 6' of connecting bar 6. Aperture 48 includes two locking fingers 46, which, in combination with connecting bar 6, allow rotation of typical door lock features found inside a door plate.

Following the above assembly, a spring holder 26 is mounted onto rotating tube 22 and snap ring 28 is locked onto the exposed end of outer spindle 4, in narrow channel 4'. Spring holder 26 includes a pair of inwardly bent arms 24 extending from its outer periphery, that function to retain return spring 30, which endows door lock assembly 99 with return force following the rotation of handle 2.

Now that one is familiar with the construction of the door lock assembly of the present invention, its mode of operation will be explained in detail.

When door lock assembly 99 is in the unlocked state, the upper portion of hook 12 will be within slot 8 of outer spindle 4 and the lower portion of hook 12 will be within slot 34 of rotating tube 22. As rotating force is applied to handle 2, outer spindle 4 and rotating tube 22 will thus rotate together and thereby cause the latch bolt (not shown) in the door to be retracted from the door latch hole in the door frame (not shown).

When door lock assembly 99 is in the locked state, a proper rotating force applied to handle 2 will not open the door, as the inner features of door lock assembly will not be allowed to rotate. However, with the application of excessive rotating force to handle 2, hook 12 will be forced upward, out of slot 34 of rotating tube 22 and in the direction of the inner periphery of coil spring 20. Outer spindle 4 will then be free to rotate over rotating tube 22 for the length of channel 44, still maintaining the integrity of the locked status. At the same time, connecting bar 6 can rotate within aperture 48 to the extent allowed by locking fingers 46. As the excessive rotating force is released, hook 12 will move downward, along the oblique faces of slot 34 due to the returning force of coil spring 20.

By inserting and rotating a key in the key cylinder of handle 2, connecting bar 6 is rotated in hole 48 of disk 47 and rotating tube 22 is rotated, and in turn, causes the latch bolt to be retracted from the door latch hole.

Figure 8:
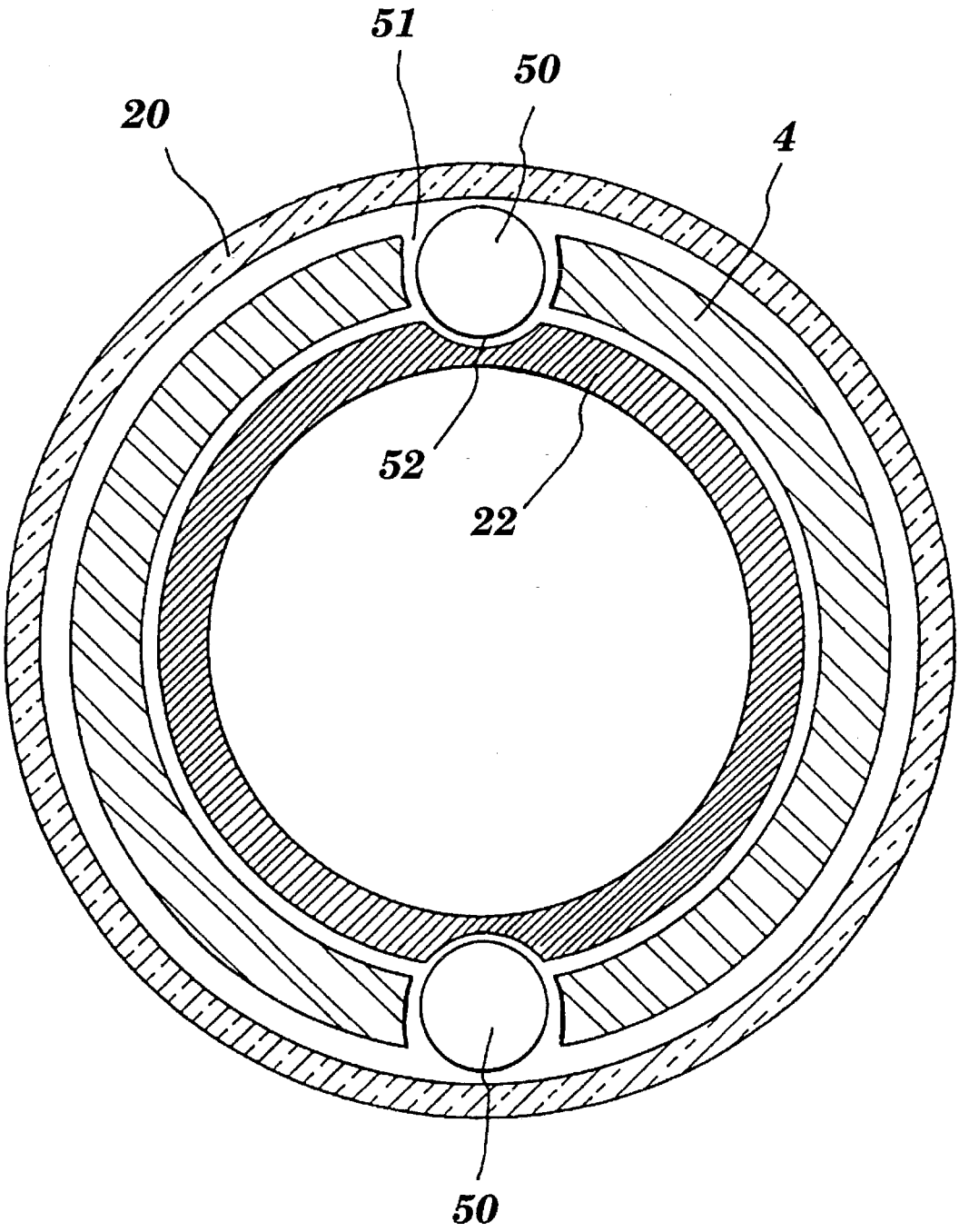
FIG. 8 is frontal view of the lock housing of another embodiment of the door lock of the present invention.

FIG. 8 shows an alternate embodiment of the present invention. Here, hook 12 is replaced by ball 50, slot 8 in outer spindle 4 is replaced by slot 51, and slot 34 in rotating tube 22 is replaced by concave depression 52. As in the preferred embodiment, when excessive force is applied to handle 2, ball 50 will be forced upward, out of depression 52, allowing outer spindle 4 to rotate without concurrently rotating rotating tube 22.

The embodiments disclosed herein have been discussed for the purpose of familiarizing the reader with the novel aspects of the invention. Although preferred embodiments of the invention have been shown, many changes, modifications and substitutions may be made by one of ordinary skill in the art without necessarily departing from the spirit and scope of the invention as described in the following claims.

I claim:

1. A door lock having:

a handle having a key cylinder;

a cylindrical open-ended outer spindle, affixed to said handle and having:

a connecting extruder projecting outward from the outer periphery of said outer spindle, proximate said handle;

a channel on said outer periphery of said outer spindle, distal from said handle; and at least one slot formed in said outer periphery of said outer spindle, distal from said handle;

a rotating tube within said outer spindle, said rotating tube having:

a slot in an outer periphery, wherein said slot in said outer spindle is aligned with said slot in said rotating tube;

a disk having a slot with two extruding fingers therein, positioned within said rotating tube, perpendicular to the longitudinal axis of said rotating tube;

a hook, shaped to be received within said slot in said outer spindle and extending inwardly within said outer spindle into said slot of said rotating tube;

a coil spring mounted over said outer spindle and said hook;

a key operating assembly mounted within said handle, wherein a connecting bar of said key operating assembly extends outward from said handle into said outer spindle and is engaged in said slot of said disk of said rotating tube;

an open-ended hollow outer housing having a narrow end wherein said narrow end is mounted over said outer spindle and affixed to said handle and wherein an inner face of said narrow end of said housing includes a channel for receiving said connecting extruder of said outer spindle;

a ting-shaped spring holder mounted over said outer spindle within said channel, wherein said ring-shaped spring holder includes a plurality of inwardly bent arms extending from an outer periphery;

a return spring retained within said inwardly bent arms of said spring holder to provide a return force when said handle is rotated; and a snap ring mounted onto said outer spindle within said channel.

2. The door lock of claim 1 wherein said at least one slot formed within said outer periphery of said outer spindle and said slot in said rotating tube each includes inwardly sloping edges and said hook is generally trapezoidal-shaped.

3. A door lock having:

a handle having a key cylinder;

a cylindrical open-ended outer spindle, affixed to said handle and having:

a connecting extruder projecting outward from the outer periphery of said outer spindle, proximate said handle;

a channel on said outer periphery of said outer spindle, distal from said handle; and at least one slot formed in said outer periphery of said outer spindle, distal from said handle;

a rotating tube within said outer spindle, said rotating tube having:

a concave recess in an outer periphery, wherein said concave recess is aligned with said slot in said outer spindle;

a disk having a slot with two extruding fingers therein, positioned within said rotating tube, perpendicular to the longitudinal axis of said rotating tube;

a ball shaped to be received within said slot in said outer spindle and extending inwardly within said outer spindle into said concave recess of said rotating tube;

a coil spring mounted over said outer spindle and said ball;

a key operating assembly mounted within said handle, wherein a connecting bar of said key operating assembly extends outward from said handle into said outer spindle and is engaged in said slot of said disk of said rotating tube;

an open-ended hollow outer housing having a narrow end wherein said narrow end is mounted over said outer spindle and affixed to said handle and wherein an inner face of said narrow end of said housing includes a channel for receiving said connecting extruder of said outer spindle;

a ring-shaped spring holder mounted over said outer spindle within said channel, wherein said ring-shaped spring holder includes a plurality of inwardly bent arms extending from an outer periphery;

a return spring retained within said inwardly bent arms of said spring holder to provide a return force when said handle is rotated; and a snap ring mounted onto said outer spindle within said channel.

* * * * *